US007210418B2

(12) United States Patent
Sakakibara

(10) Patent No.: US 7,210,418 B2
(45) Date of Patent: May 1, 2007

(54) SEWING APPARATUS, THREAD CASSETTE THEREFOR AND CONTROL PROGRAM THEREFOR

(75) Inventor: Kaoru Sakakibara, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 120 days.

(21) Appl. No.: 10/607,147

(22) Filed: Jun. 27, 2003

(65) Prior Publication Data

US 2004/0000263 A1 Jan. 1, 2004

(30) Foreign Application Priority Data

Jun. 28, 2002 (JP) ..... 2002-189517

(51) Int. Cl.
*D05B 59/00* (2006.01)

(52) U.S. Cl. ..... 112/302

(58) Field of Classification Search ..... 700/136, 700/137, 138; 112/470.01, 270, 277, 302, 112/466

See application file for complete search history.

(56) References Cited

U.S. PATENT DOCUMENTS

| | | | | |
|---|---|---|---|---|
| 3,749,039 | A | 7/1973 | Fritts | |
| 3,874,312 | A * | 4/1975 | Cook et al. | 112/466 |
| 4,163,997 | A * | 8/1979 | Sugihara | 360/137 |
| 4,183,313 | A * | 1/1980 | Odermann et al. | 112/302 |
| 6,467,519 | B1 | 10/2002 | Hori | |
| 6,814,016 | B2 * | 11/2004 | Hori | 112/225 |
| 6,860,212 | B2 | 3/2005 | Fukao | |
| 6,883,447 | B1 | 4/2005 | Kitazawa | |

FOREIGN PATENT DOCUMENTS

| | | |
|---|---|---|
| JP | 11076670 | 9/1999 |
| JP | A 2000-398263 | 12/2000 |
| JP | A 2002-91558 | 3/2002 |
| JP | A 2002-91561 | 3/2002 |
| JP | 2002-095882 | 4/2002 |
| JP | A-2002-191884 | 7/2002 |
| JP | 2003-284884 | 10/2003 |
| JP | 2003-284887 | 10/2003 |
| WO | WO 02/053822 A1 | 7/2002 |
| WO | WO 02053821 | 7/2002 |

OTHER PUBLICATIONS

European Search Report.

* cited by examiner

*Primary Examiner*—Danny Worrell
(74) *Attorney, Agent, or Firm*—Oliff & Berridge, PLC

(57) ABSTRACT

A sewing apparatus is disclosed in which a thread cassette holding a needle thread wound is used. The sewing apparatus includes a cassette mount to which the thread cassette is detachably attached, a carrier carrying the thread cassette between an attachment start position and an attachment finish position in the cassette mount and a control device for electrically controlling rotation of a motor that moves the carrier.

25 Claims, 12 Drawing Sheets

SEWING APPARATUS, THREAD CASSETTE THEREFOR AND CONTROL PROGRAM THEREFOR

BACKGROUND OF THE INVENTION

1. Field of the Invention

This invention relates to a sewing apparatus including a sewing mechanism in which a thread cassette holding a needle thread is used and a control program therefor.

2. Description of the Related Art

U.S. Pat. No. 3,749,039 to Russell A. Fritts discloses a sewing apparatus with a cassette mount to which a thread cassette holding a needle thread wound on a thread spool is attached. In the disclosed sewing apparatus, a user pushes the thread cassette downward while holding the thread cassette in hand, in order that the thread cassette may be attached to the cassette mount of the sewing apparatus. Furthermore, when the thread cassette is to be ejected from the cassette mount, the user raises the thread cassette while holding the cassette in hand.

The above-described manual handling of the thread cassette imposes load on the user, and furthermore, force applied to the thread cassette differs in the magnitude from one user to another. Accordingly, each mechanism of the sewing apparatus is required to have a sufficient performance to cope with every condition. For example, the thread cassette is not always attached to the cassette mount under a constant condition. Accordingly, when threading is carried out upon attachment of the thread cassette, an operating condition of the threading mechanism needs to be determined so as to be reliably carried out in a wide range. As a result, the construction of the sewing apparatus is complicated.

SUMMARY OF THE INVENTION

Therefore, an object of the present invention is to provide a sewing apparatus in which the thread cassette is carried by a carrier so that thread cassette can be attached to and ejected from the cassette mount under a constant condition.

The present invention provides a sewing apparatus in which a thread cassette holding a needle thread wound is used, comprising a cassette mount to which the thread cassette is detachably attached, a carrier carrying the thread cassette between an attachment start position and an attachment finish position in the cassette mount, and a control device for controlling rotation of a motor that moves the carrier.

In the above-described sewing apparatus, the control device controls the carrier so that the thread cassette is automatically inserted into and ejected from the cassette mount. Furthermore, the thread cassette can be attached to the cassette mount under a predetermined condition.

In a preferred form, the carrier includes a contract member brought into contact with the thread cassette or a supporting member when the thread cassette is supported by the supporting member and a driver for moving or rotating the contact member. Furthermore, the control device controls the driver so that the contact member is moved or rotated in a predetermined direction for insertion of the thread cassette into the cassette mount.

BRIEF DESCRIPTION OF THE DRAWINGS

Other objects, features and advantages of the present invention will become clear upon reviewing the following description of an embodiment of the invention, made with reference to the accompanying drawings, in which.

DETAILED DESCRIPTION OF THE INVENTION

Figure 1:
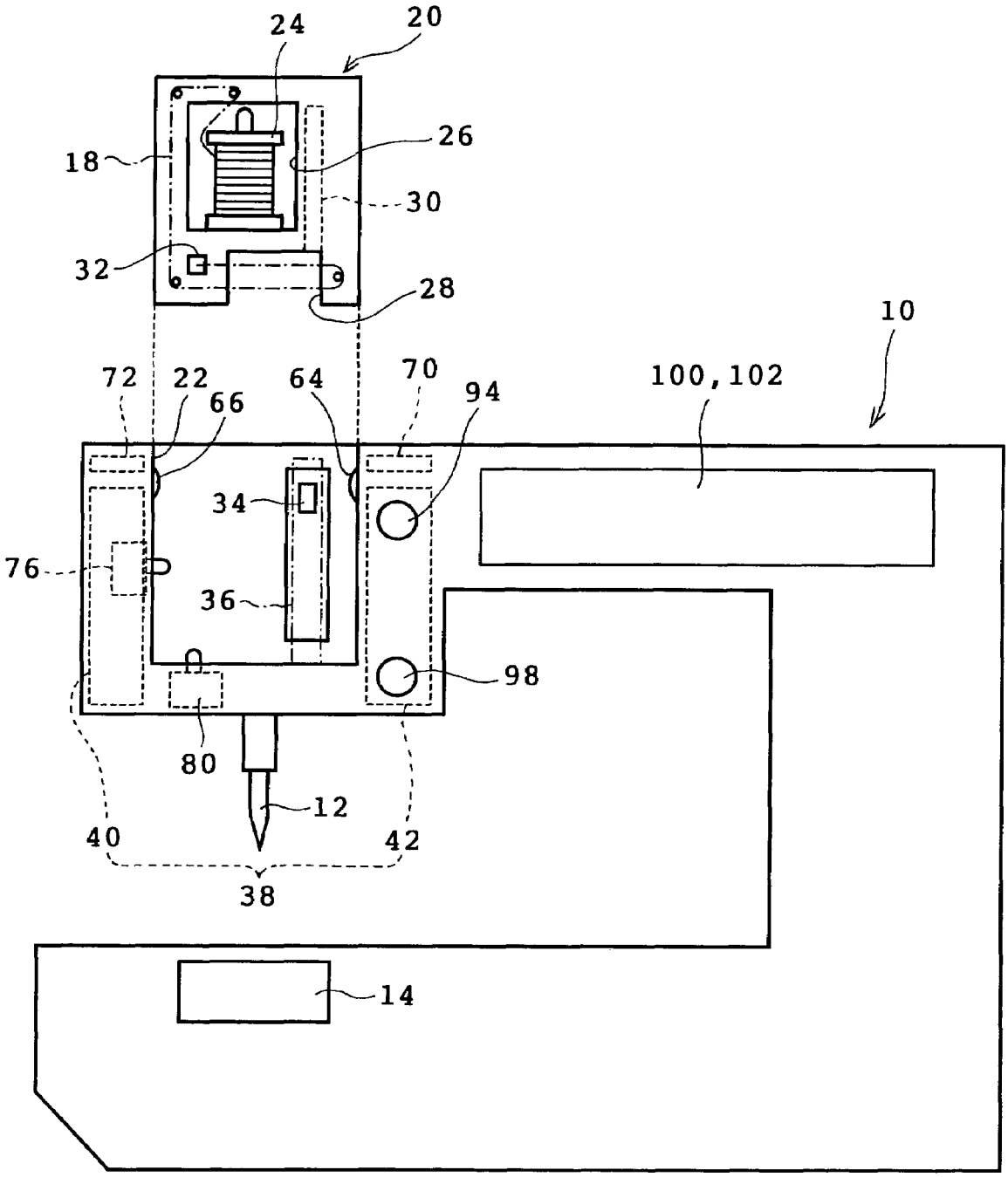
FIG. 1 is a front view of a sewing apparatus and a thread cassette in accordance with one embodiment of the present invention.
Figure 2:
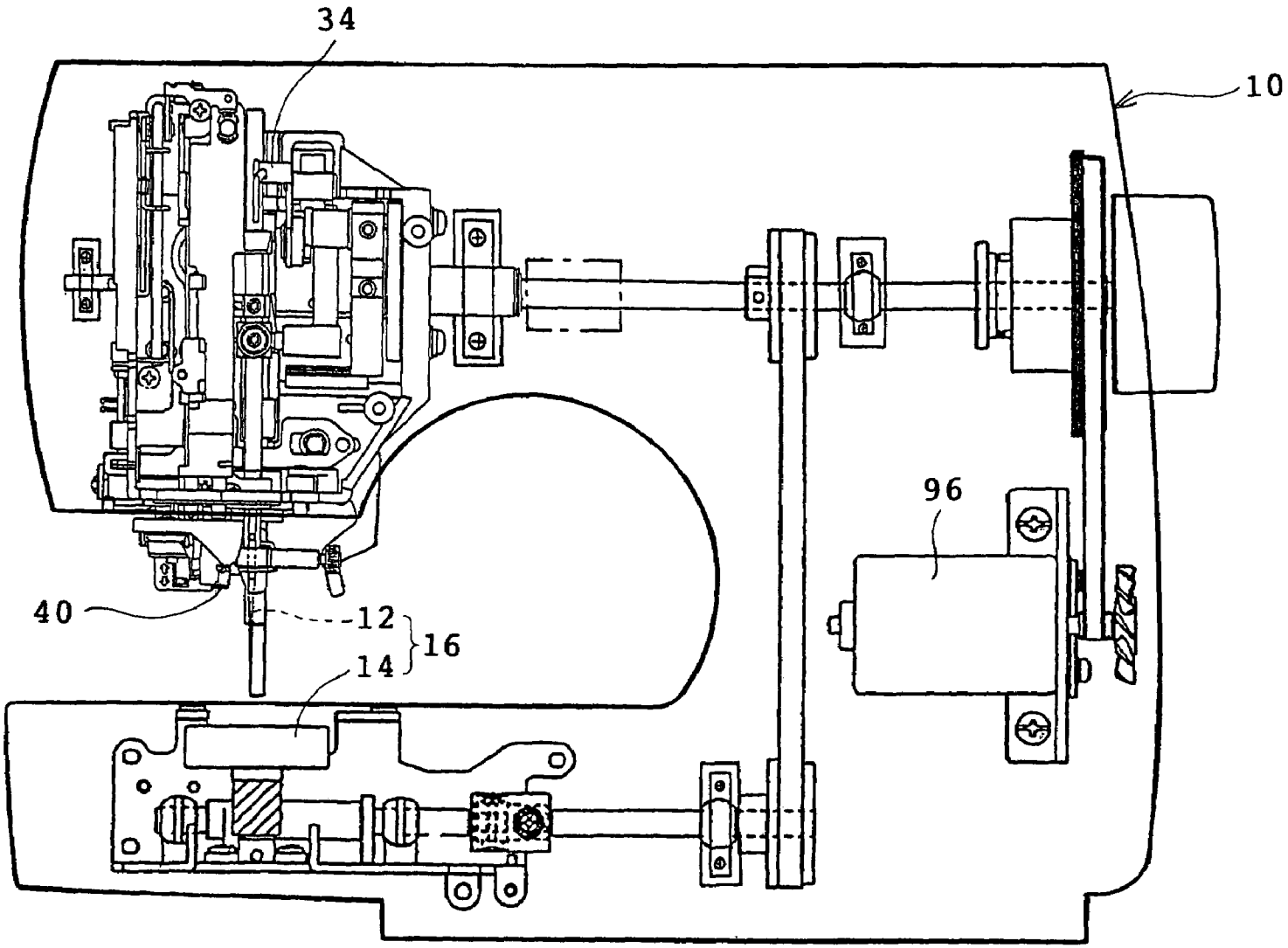
FIG. 2 is a broken front view of the sewing apparatus.
Figure 3:
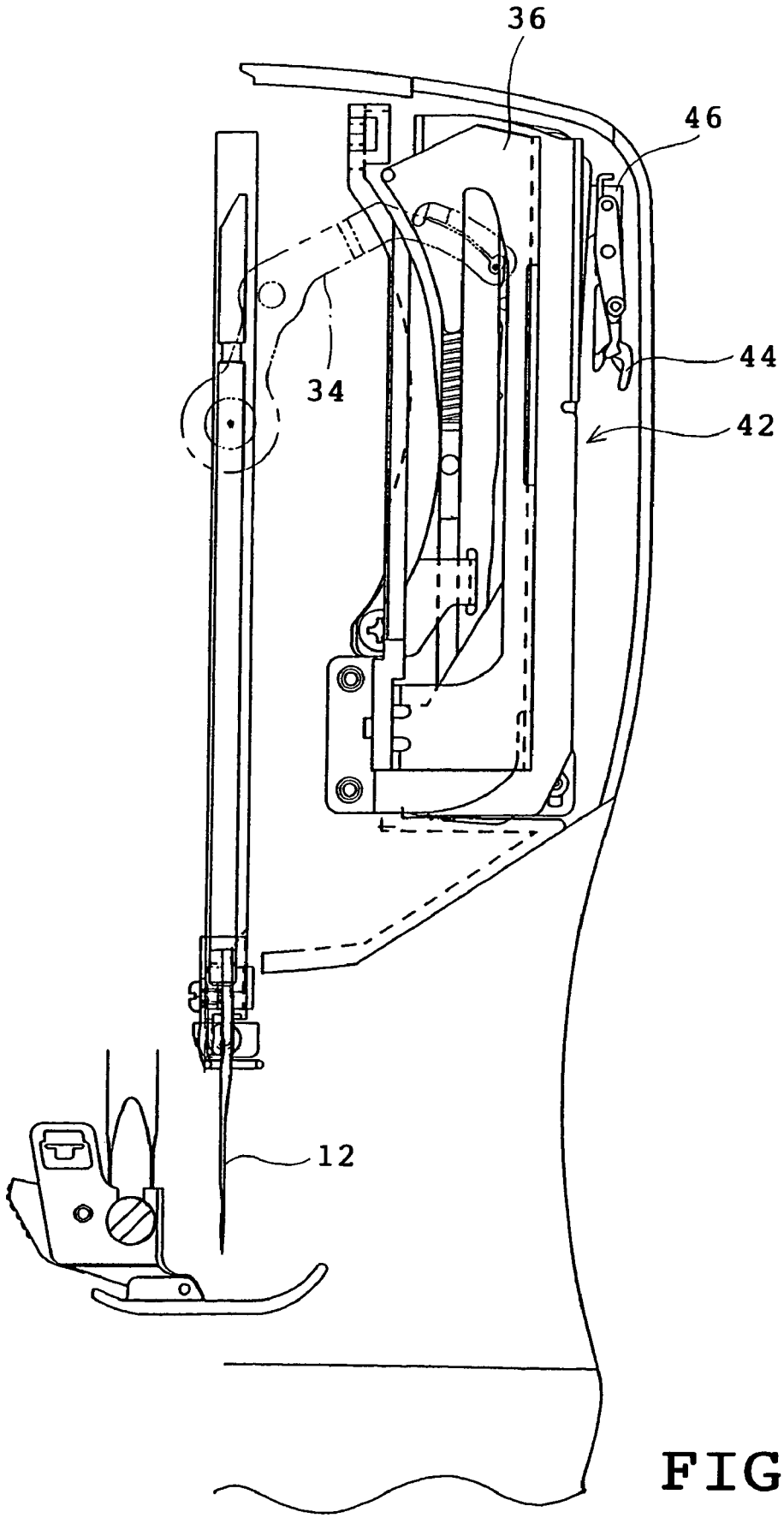
FIG. 3 is a right side view a thread tensioning mechanism and a needle thread take-up.
Figure 4:
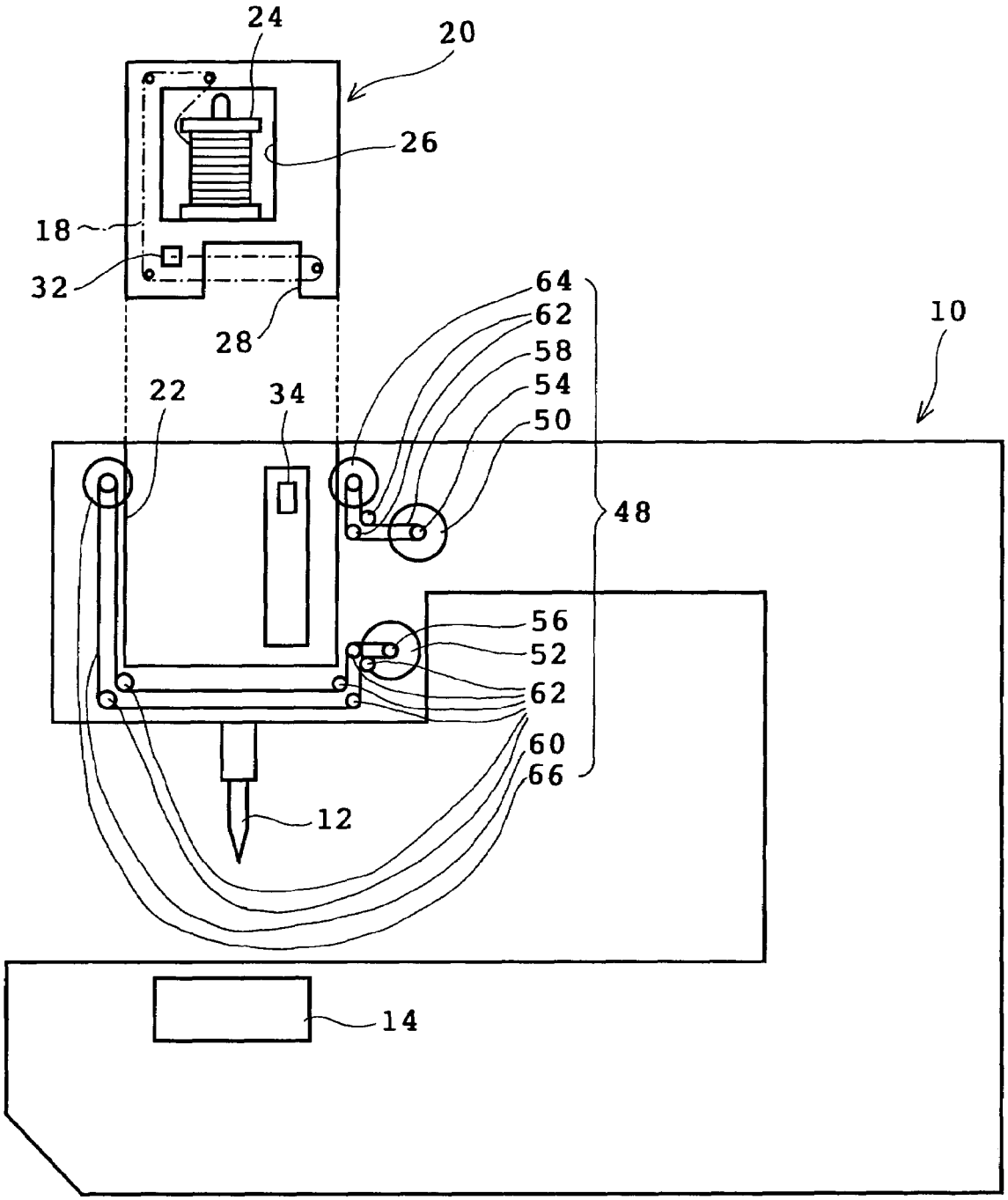
FIG. 4 is a schematic diagram of a carrying mechanism.

One embodiment of the present invention will be described with reference to the accompanying drawings. Referring to FIGS. 1 to 4, a sewing machine 10 serving as a sewing apparatus comprises a sewing mechanism including a sewing needle 12 moved up and down and a shuttle 14 rotated in synchronization with the movement of the needle 12 as disclosed in Japanese Patent Application No. 2000-398263 filed by the assignee of the present application. The sewing machine 10 further comprises a cassette mount 22 to which a thread cassette 20 holding a needle thread used in the sewing mechanism is detachably attached. In use of the sewing machine 10, the thread cassette 20 is attached to the cassette mount 22.

The thread cassette 20 includes a thread accommodating cavity 23 for accommodating a thread spool 24 on which a needle thread 18 is wound. The thread spool 24 accommodated in the cavity 23 is covered with a lid (not shown). When the thread cassette 20 is attached to the cassette mount 22, the user draws the needle thread 18 out of the thread spool 24, extending the thread along a guide groove (not shown) formed in the top of the thread cassette 20 so that the thread extends around the thread cassette. More specifically, the needle thread 18 is drawn upward from the thread spool 24, being extended leftward along the guide groove and then bent downward, as viewed in FIG. 1. The needle thread 18 is then bent rightward at the lower portion of the thread cassette 20. The thread cassette 20 has an opening 28 formed therein so as to face the needle thread 18 extending horizontally and so as to be open downward. A needle thread take-up moving space 30 extending vertically is defined in the thread cassette 20 so as to communicate with the opening 28.

A distal end of the needle thread 18 is bent forward, getting out of the guide groove. The needle thread 18 is then bent leftward, and the distal end of the thread is engaged with a thread engaging member 32 provided on the left front of the thread cassette 20. Thus, the needle thread 18 extends along the front of the thread cassette 20.

Furthermore, the sewing machine 10 is provided with a needle thread take-up 34 and a needle thread take-up eyelet 36 as disclosed in Japanese Patent Application No. 2002-91561 filed by the assignee of the present application. When the thread cassette 20 is attached to the sewing machine 10, the needle thread 18 extending in the right-and-left direction is once moved in the rear of the sewing machine 10 along the needle thread take-up eyelet 36 with downward movement of the thread cassette 20. Upon further downward movement of the thread cassette 20, the needle thread 18 is moved in front of the sewing machine 10 to be caught on the needle thread take-up 34. The needle thread take-up 34 and the needle thread take-up eyelet 36 are inserted into the needle thread take-up moving space 30 through the opening 28 below the thread cassette 20 lowered.

The sewing machine 10 is further provided with a threading mechanism 38 causing the needle thread 18 to pass through a hole (not shown) of the needle with the downward movement of the thread cassette 20 as disclosed in Japanese Patent application No. 2002-91558 filed by the assignee of the present application. The threading mechanism 38 comprises a threading hook mechanism 40 disposed on the left of the cassette mount 22 and a thread tensioning mechanism 42 disposed on the right of the cassette mount 22. When the thread cassette 20 is moved downward in the cassette mount 22, a threading shaft (not shown) having a threading hook (not shown) is moved downward by a first pressed member pressed by the thread cassette 20. Furthermore, the threading shaft is swung to be rotated in the rear of the hole of the needle 12 so that the threading hook is caused to go into the hole (not shown) of the needle 12 and then leave the hole.

When the thread cassette 20 is moved downward in the cassette mount 22, a supporting member 46 is moved downward by a second pressed member (not shown). The supporting member 46 has a thread catching member 44 catching the needle thread 18 of the thread cassette 20. The thread catching member 44 is temporarily stopped in front of the hole of the needle 12 so that the needle thread 18 is tensioned. The supporting member 46 is moved upward when the threading hook catches the needle thread 18 and then leaves. A distal end of the needle thread 18 is disengaged from a thread engaging member 32 when the needle thread 18 is caught by the thread catching member 44 and moved downward.

Thus, the needle thread 18 extending in the right-and-left direction along the front of the thread cassette 20 is caught by the thread catching member 44 and then moved downward. The needle thread 18 is tensioned by the thread catching member 44 in front of the hole of the needle 12. The needle thread 18 is then brought through the needle hole by the threading hook of the threading mechanism.

The sewing machine 10 includes a carrying mechanism 48 for carrying the thread cassette 20 vertically between an attachment start position and an attachment finish position relative to the cassette mount 22. The carrying mechanism 48 includes two pulse motors 50 and 52 mounted in the sewing machine 10, pulleys 54 and 56 fixed to motor shafts of the respective pulse motors, timing belts 58 and 50 conveyed by the respective pulleys, rotatable driven rollers 62 provided at bent portions of the timing belts respectively, and rubber rollers 64 and 66 rotated via the timing belts by the pulse motors respectively.

The rubber rollers 64 and 66 are disposed so that portions of circumferences of the rollers are opposed to each other so as to project to the inside of the cassette mount 22 at locations slightly lower than an entrance (top end) of the cassette mount respectively. A space between the rubber rollers 64 and 66 is set to be slightly smaller than a width of the thread cassette 20. When the thread cassette 20 is inserted into the cassette mount 22 so as to be located at the attachment start position between the rubber rollers 64 and 66, the rollers are elastically deformed slightly and brought into contact with flat right and left side faces of the thread cassette 20 respectively. The rubber rollers 64 and 66 are brought into contact with upper side faces of the thread cassette 20 even when the thread cassette reaches the lowermost attachment finish position.

When the pulse motors 50 and 52 are rotated in a predetermined direction, the rubber rollers 64 and 66 are rotated so that the thread cassette 20 is moved while being held by the rubber rollers, whereby the thread cassette is attached to or ejected from the cassette mount 22. The rubber rollers 64 and 66 serve as contact members in the invention. The pulse motors 50 and 52 serve as drivers for the contact members. The aforesaid flat side faces of the thread cassette 20 serve as contacted members.

A light emitting element 70 and a light detecting element 72 both serving as a first detector are disposed just above the projecting portions of the rubber rollers 64 and 66, near the entrance of the cassette mount 22 so as to be opposed to each other. A limit switch 76 is disposed at a vertically middle portion of the cassette mount 20 below the projecting portions of the rubber rollers 64 and 66. The limit switch 76 detects a vertically middle position of the thread cassette 20 in the cassette mount 22. The limit switch 76 serves as an ejection detector and includes a detecting section located on a movement path of the thread cassette 20 so as to be brought into contact with the left side face of the thread cassette. The cassette mount 22 includes a lowermost horizontal portion on which another limit switch 80 serving as a second detector is disposed. The limit switch 80 includes a detecting section projecting upward from the horizontal portion. The limit switch 80 is disposed so as to be brought into contact with the underside of the thread cassette 20 on the movement path of the thread cassette. The ejection detector may be used as the limit switch 80.

Figure 5:
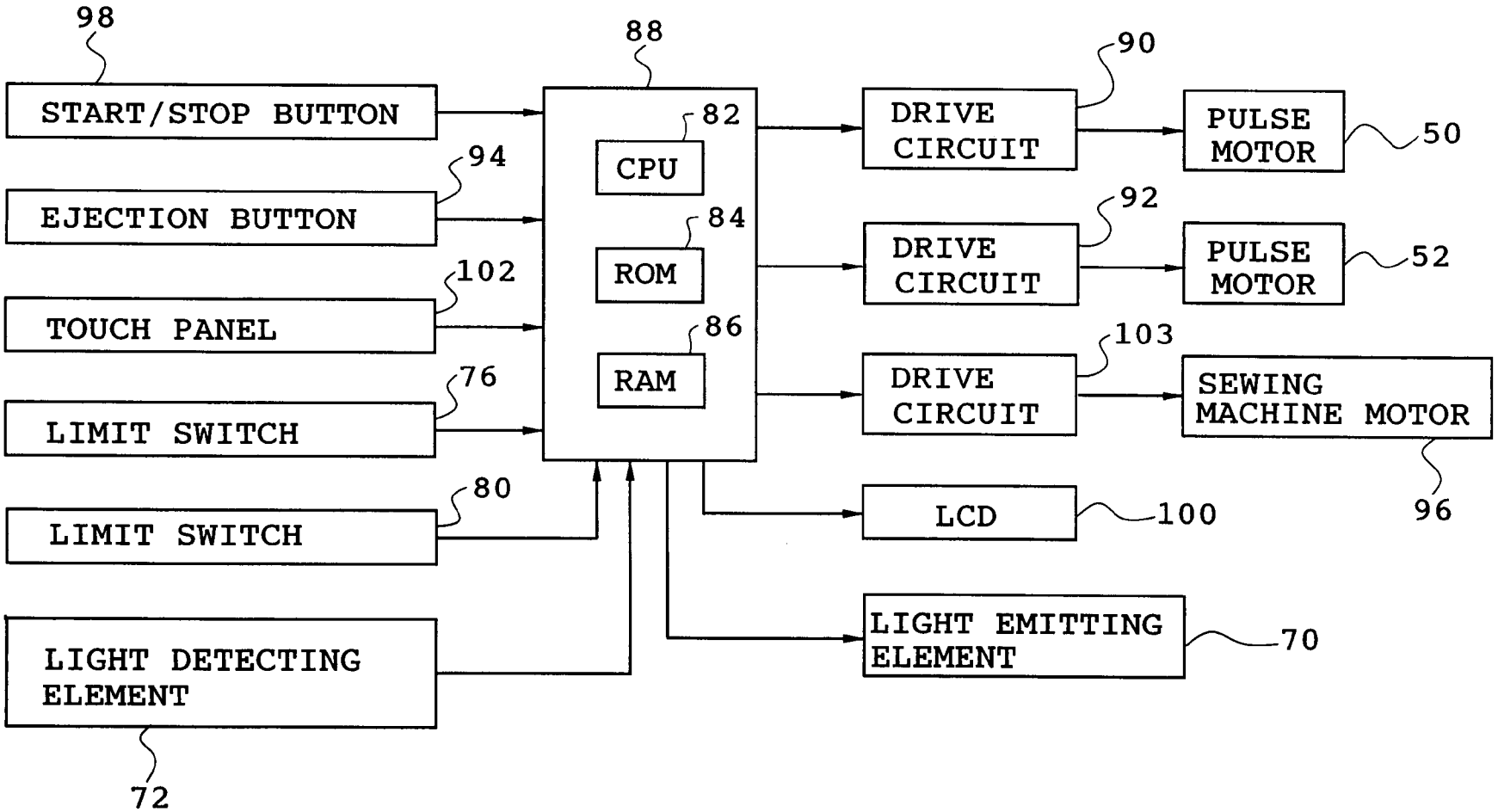
FIG. 5 is a block diagram showing an electrical arrangement of the sewing apparatus.
Figure 6:
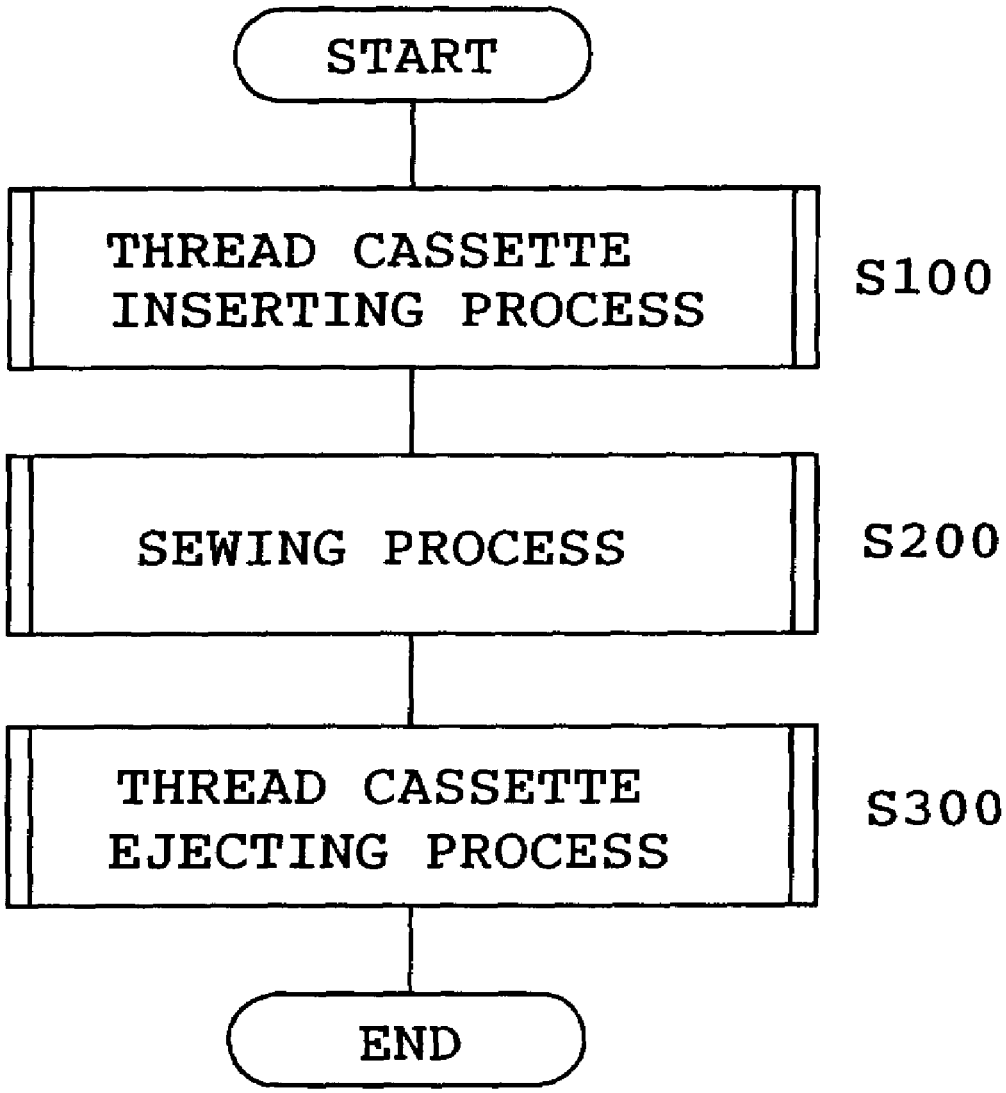
FIG. 6 is a flowchart showing an overall control program.
Figure 7:
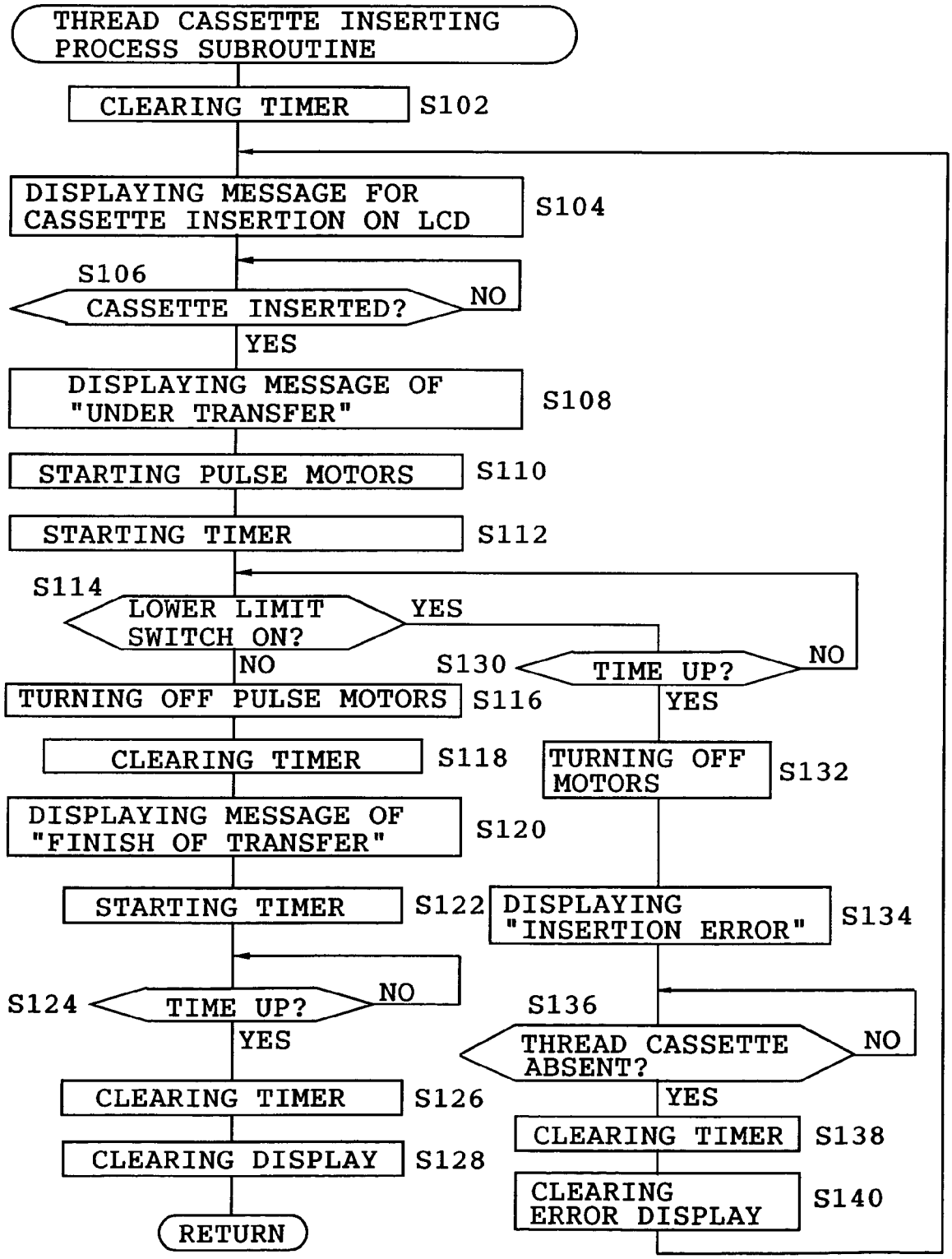
FIG. 7 is a flowchart showing a subroutine for thread cassette inserting process.
Figure 8:
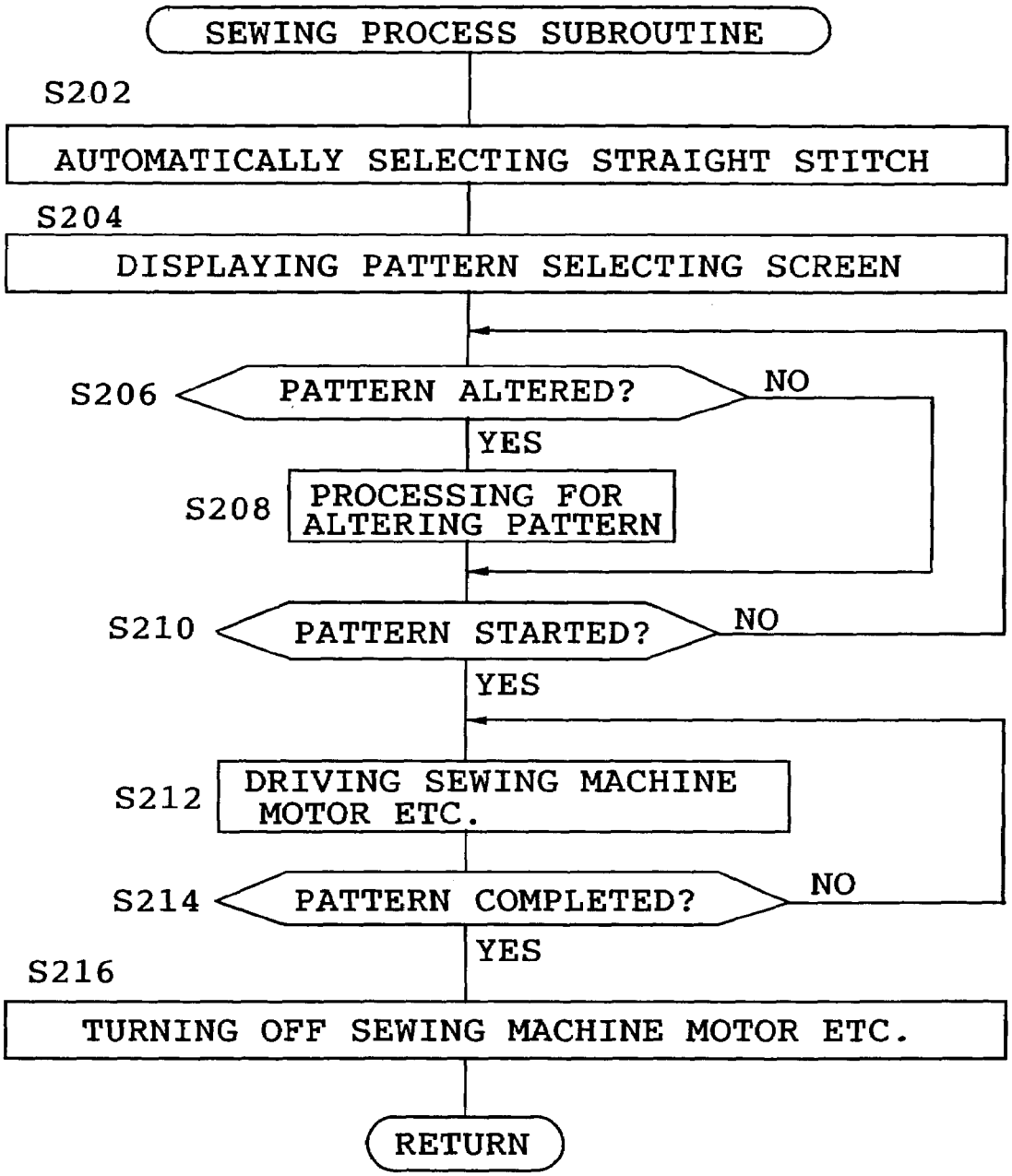
FIG. 8 is a flowchart showing a subroutine for a sewing process.
Figure 9:
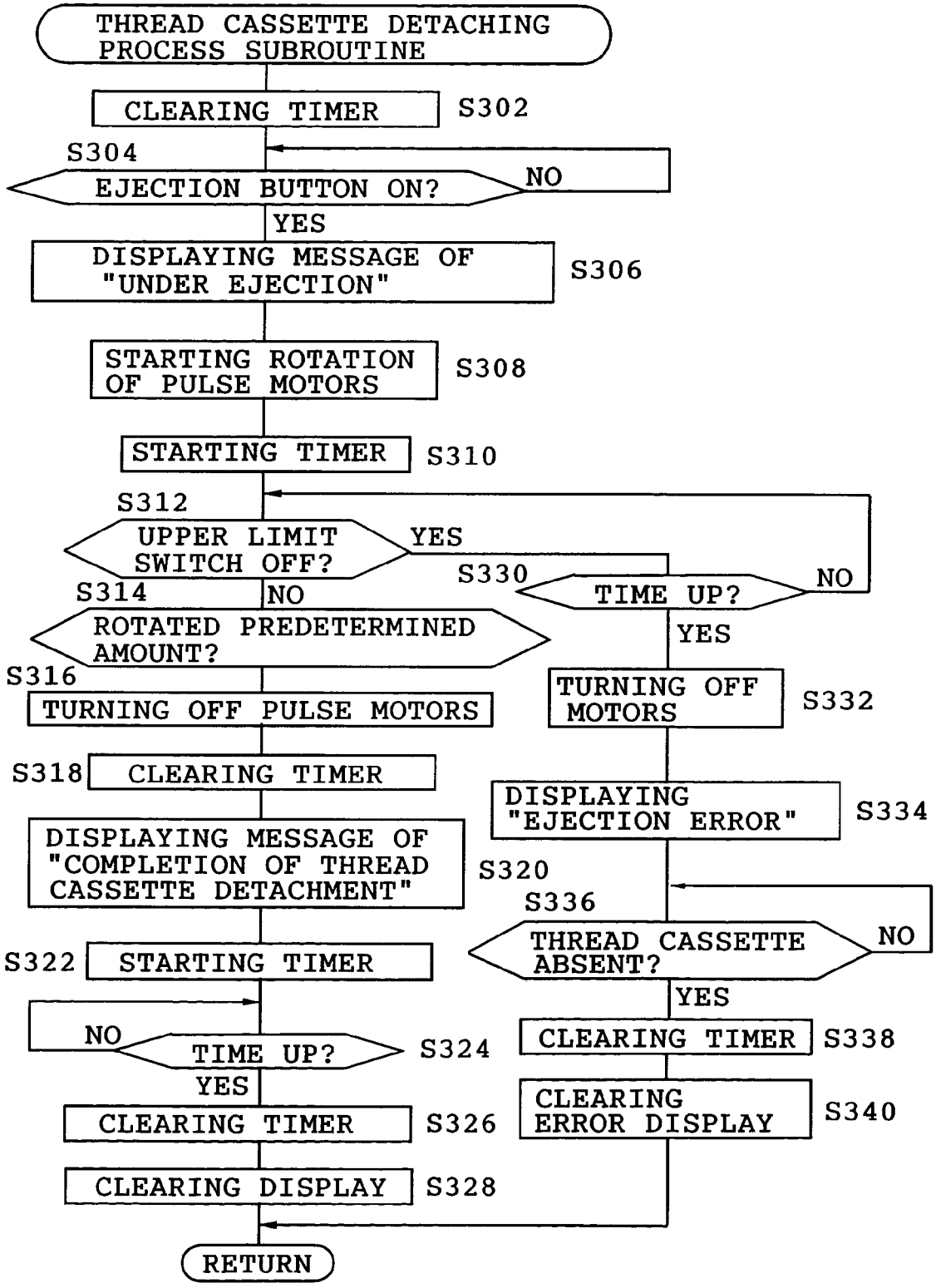
FIG. 9 is a flowchart showing a subroutine for a thread cassette ejecting process.

The aforesaid pulse motors 50 and 52 are connected via respective drive circuits 90 and 92 to a control device 88 as shown in FIG. 5. The motors 50 and 52 are thus controlled by the control device 88 The control device 88 comprises CPU 82, ROM 84, RAM 86, etc. ROM 84 stores a control program for controlling the pulse motors 50 and 52 and a control program for controlling the sewing operation. Necessary data is temporarily written onto RAM 86 during execution of each control program. The control device 88 has a timing function to successively writing counts onto RAM 86 so that time-up is detected.

The light emitting element 70, light detecting element 72 and limit switches 76 and 80 are connected to the control device 88 so that the results of detection is supplied to the control device. To the control device 88 are further connected an ejection button 94 operated so that the pulse motors 50 and 52 are driven in order that the thread cassette 20 may be ejected from the cassette mount 22, a sewing machine motor 96 for driving the sewing mechanism 16, a start/stop button 98 for starting or stopping the sewing machine motor 96, LCD 100 for displaying various messages and patterns, and a transparent touch panel 102. The sewing machine motor 96 is connected via a drive circuit 103 to the control device 98.

FIGS. 6 to 9 illustrate operations for inserting the thread cassette 20 into and ejecting the thread cassette 20 from the cassette mount 22. When the sewing machine 10 is connected to the power supply, the control device 88 carries out a thread cassette inserting process (S100), sewing process (step S200), and thread cassette ejecting process (step S300) successively. In the thread cassette inserting process (step S100), the control device 88 firstly clears the timer (step S102) and then displays, on LCD 100, a message urging the user to insert the thread cassette 20 into the cassette mount 22 (step S104). Based on the fact that the light detecting element 72 is detecting a predetermined amount of light from the light emitting element 70, the control device 88 is on standby until the thread cassette 20 is inserted into the entrance of the cassette mount 22 (step S106).

When the user inserts the thread cassette 20 slightly into the cassette mount 22 from above, light emitted from the light emitting element 70 is intercepted by the thread cassette 20. Accordingly, since the light detecting element 72 cannot detect the predetermined amount of light from the light emitting element 70, the control device 88 detects the thread cassette 20 having been inserted in the cassette mount 22 (YES at step S106). Consequently, the control device 88 detects the thread cassette 20 having reached a drive start position where rotation of the rubber rollers 64 and 66 is started. The thread cassette 20 is brought into contact with the rubber rollers 64 and 66 below the light emitting and detecting elements 70 and 72. The rubber rollers 64 and 66 are elastically deformed slightly thereby to adhere closely to the side faces of the thread cassette 20. Thus, the thread cassette 20 is held between the rubber rollers 64 and 66.

The control device 88 then displays on the LCD 100 a message that the thread cassette 20 is under transfer in the cassette mount 22 (step S108). The pulse motors 50 and 52 are rotated so that the rubber rollers 64 and 66 move the thread cassette 20 downward (step S110). More specifically, the pulse motor 50 for driving the right-hand rubber roller 64 is rotated counterclockwise thereby to rotate the roller counterclockwise, whereas the pulse motor 52 for driving the left-hand rubber roller 66 is rotated clockwise thereby to rotate the roller clockwise. As a result, the thread cassette 20 held between the rubber rollers 64 and 66 is automatically moved downward in the cassette mount 22. Accordingly, the user need not operate the sewing machine 10 to input rotational directions for the respective pulse motors 50 and 52 every time when the thread cassette 20 is inserted into the cassette mount 22, whereupon the convenience of the sewing machine 10 can be improved. When the thread cassette 20 is moved downward by the rollers 64 and 66, the limit switch 76 is pressed by the left-hand side wall of the cassette to be turned on. The status of the limit switch 76 is monitored by the control device 88.

The control device 88 starts the counting operation of the timer (step S112) when the pulse motors 50 and 52 are rotated. The control device 88 is on standby until the thread cassette 20 is moved downmost by the rubber rollers 64 and 66 (step S14). When the limit switch 80 is pressed by the underside of the thread cassette 20, the control device 88 recognizes this (step S114), whereupon the control device detects the thread cassette 20 having reached a drive stop position where the rubber rollers 64 and 66 in rotation are stopped. Thus, the control device 88 detects normal transfer of the thread cassette 20 into the cassette mount 22. Successively, the control device 88 stops rotation of the pulse motors 50 and 52 (step S116) so that rotation of the rubber rollers 64 and 66 is stopped. Thus, since the transfer (insertion) of the thread cassette 20 is automatically stopped, the user need not operate the sewing machine 10 to stop rotation of the pulse motors 50 and 52 every time when the thread cassette 20 is inserted into the cassette mount 22, whereupon the convenience of the sewing machine 10 can be improved.

The control device 88 then controls the LCD 100 so that a message indicative of completion of transfer of the thread cassette 20 is displayed on the LCD for a predetermined period of time (steps S118 to S130). With downward movement of the thread cassette 20 in the cassette mount 22, the threading mechanism 38 causes the needle thread 18 to pass through the hole of the needle 12, and the needle thread is also caught by the thread take-up lever 34, whereupon the preparation for start of the sewing operation is substantially completed.

The control device 88 stops the pulse motors 50 and 52 (step S132) when the thread cassette 20 has not been transferred to the lowermost position in the cassette mount 22 for some reason (for example, wear of the rollers 64 and 66) within a predetermined period of time from rotation of the motor 50 and 52 (YES at step S130). Thus, the transfer (insertion) of the thread cassette 20 by the rollers 64 and 66 is automatically stopped when push of the limit switch 80 is not detected within the predetermined period of time after start of rotation of the motors 50 and 52. Accordingly, no particular input is required for stop of the motors 50 and 52 even when the thread cassette 20 has not reached the predetermined position in the cassette mount 22. Consequently, the convenience of the sewing machine 10 can be improved.

The control device 88 then displays on the LCD 100 a transfer error message indicative of failure in the transfer of the thread cassette in the cassette mount 22, and the display of the transfer error message is continued until absence of the thread cassette 20 in the cassette mount 22 is detected (steps S134 to S140). The control device 88 detects the absence of the thread cassette 20 in the cassette mount 22 when the limit switch 76 is not pressed by the thread cassette 20 and accordingly turned off and when the light detecting element 72 receives a predetermined amount of light. The limit switch 76 and the light emitting and detecting elements 70 and 72 serve as a thread cassette detector. Furthermore, the thread cassette 20 is sometimes ejected manually from the cassette mount 22 for re-insertion. This is also detected by the thread cassette detector. Successively, when determining that the thread cassette 20 is absent in the cassette mount 22 (step S136), the control device 88 displays on the LCD 100 the instruction to insert the thread cassette 20 in the same manner as at the time of connection to the power supply (step S104).

A sewing process (step S200) is executed for a normal sewing operation when the thread cassette insertion process (step S100) is completed with the thread cassette located at the lowermost position in the cassette mount 22 as described above. In the sewing process, the control device 88 automatically selects a straight stitch as an initial pattern (step S202) and displays on the LCD 100 a pattern selecting screen on which a pattern other than the straight stitch can be selected (step S204). When the pattern is changed via the transparent touch panel 102 by the user (YES at step S206), a pattern changing process according to the changes is carried out (step S208). When the start/stop button 98 is operated for start of the sewing operation (YES at step S210), the control device 88 controls the sewing machine motor 96 and the like so that a sewing operation is carried out for the selected pattern (steps S212 to S216).

When the ejection button 94 is operated by the user after completion of the above-described sewing process (YES at step S304), the control device 88 displays, on the LCD 100, a message indicating that the thread cassette 20 is being ejected (step S306) and then controls the pulse motors 50 and 52 so that the pulse motors and rubber rollers 64 and 66 are rotated a predetermined amount so that the thread cassette 20 is moved upward (step S308). Successively, the control device 88 starts count by the timer function (step S310). More specifically, when the ejection button 94 is depressed by the user, the pulse motor 50 driving the right-hand rubber roller 64 is rotated clockwise and the pulse motor 52 driving the left-hand rubber roller 66 is rotated counterclockwise, whereupon the thread cassette 20 is moved upward in the cassette mount 22. Thus, the rubber rollers 64 and 66 are rotated in the respective directions so that the thread cassette 20 is automatically transferred (ejected) from the cassette mount 22. Accordingly, the user need not operate the sewing machine for input of the rotational directions of the pulse motors 50 and 52.

The aforesaid amount of rotation is set so that the thread cassette 20 projects sufficiently from the top of the sewing machine 10 in order that the thread cassette having been moved upward may manually be pulled out. Thus, the rubber rollers 64 and 66 are rotated by the predetermined amount rotation so that the thread cassette 20 is automatically transferred (ejected) from the cassette mount 22. Accordingly, since the user need not input an amount of rotation of the rubber rollers 64 and 66 every time the thread cassette 20 is transferred, the convenience of the sewing machine can be improved. The number of pulses supplied to each of the pulse motors 50 and 52 which are controlled in ejection of the thread cassette 20 is determined on the basis of the predetermined amount of rotation. Furthermore, the control device 88 determines whether the pulse motors 50 and 52 and the rubber rollers 64 and 66 have been rotated by the predetermined amount of rotation, based on the number of drive pulses supplied to the pulse motors 50 and 52 in the ejection process.

The control device 88 stops the pulse motors 50 and 52 (step S332) when the thread cassette 20 has not been moved upward to a lowermost position where the detecting section of the limit switch 76 is not pressed by the side walls of the thread cassette, within a predetermined period of time starting from rotation of the pulse motors for some reason (for example, wear of the rubber rollers) (YES at step S330). Thus, the transfer or ejection of the thread cassette 20 by the rubber rollers 64 and 66 is automatically stopped when depression of the limit switch 76 is not detected within a predetermined period of time from start of rotation of the pulse motors 50 and 52. Accordingly, the user need not operate the sewing machine to stop the pulse motors 50 and 52 even when the thread cassette 20 does not reach a predetermined position under a predetermined condition. Consequently, the convenience of the sewing machine can be improved.

The control device 88 then displays, on the LCD 100, a transfer error message indicative of failure in the transfer of the thread cassette in the cassette mount 22, and the display of the transfer error message is continued until the absence of the thread cassette 20 in the cassette mount 22 is detected (steps S334 to S340). Whether the thread cassette 20 is present in the cassette mount 22 is detected by a thread cassette detector comprising the limit switch 76 and light emitting and detecting elements 70 and 72. More specifically, the control device 88 detects the absence of the thread cassette 20 in the cassette mount 22 when the limit switch 76 is not pressed by the thread cassette 20 and accordingly turned off and further when the light detecting element 72 receives the predetermined amount of light. Thus, the thread cassette 20 having been manually pulled out is detected. Successively, when determining that the thread cassette 20 is absent in the cassette mount 22 (step S336), the control device 88 clears the timer and display (step S338), returning to the thread cassette insertion process (step S100).

In the foregoing embodiment, the sewing machine 10 includes the threading mechanism 38 having a member moved by the thread cassette 20, and the thread cassette 20 is automatically transferred by the transfer mechanism 48. Accordingly, the transfer speed of the thread cassette 20, the load for the transfer, etc. are constant as compared with the case where the thread cassette is manually transferred. Consequently, since operating conditions of the threading mechanism 38 are unified, the threading mechanism can be designed more easily as compared with the case where the threading mechanism is designed according to numerous operating conditions of the manual operation.

The pulse motors 50 and 52 are provided as the actuators operated in the insertion and ejection of the thread cassette 20 in the foregoing embodiment. However, the actuators may be operated for either insertion or ejection of the thread cassette, instead. Furthermore, although the pulse motors serve as the actuators in the foregoing embodiment, servo motors or solenoids may be used as the actuators, instead.

The two pulse motors 50 and 52 are provided for rotating the two rubber rollers 64 and 66 respectively in the foregoing embodiment. However, a single pulse motor may be provided for rotating the two rubber rollers 64 and 66, or the transfer mechanism 48 may comprise a single pulse motor and a single rubber roller rotated by the single pulse motor for the insertion and ejection of the thread cassette 20, instead. Furthermore, the exclusive pulse motors 50 and 52 are provided for the rubber rollers 64 and 66 respectively in the foregoing embodiment. However, another pulse motor provided for another function in the sewing machine may be used to rotate the rubber rollers 64 and 66, instead. Such a motor may include a pulse motor for swinging a needle, a pulse motor for automatic threading, a pulse motor for automatic thread tensioning and a pulse motor for adjusting feed pitch of a feed dog.

In the foregoing embodiment, the insertion of the thread cassette 20 into the cassette mount 22 is detected by the light emitting and detecting elements 70 and 72 so that the pulse motors 50 and 52 automatically start. However, the user may operate an insertion button provided on the sewing machine so that the pulse motors start, instead.

Furthermore, in the foregoing embodiment, the control device 88 stops the pulse motors 50 and 52 when the thread cassette 20 has not been transferred to the lowermost position in the cassette mount 22 for some reason within the predetermined period of time from rotation of the motor 50 and 52. Although the count starts from the time when the rotation of the pulse motors starts, it may start from the time when the limit switch 76 is depressed by the side walls of the thread cassette 20, instead, for example. Thus, the count may start from another phase. Furthermore, the time when the driver is stopped is determined on the basis of the aforesaid predetermined period of time in the foregoing embodiment. However, the time may be determined on the basis of the number of drive pulses supplied to the pulse motors 50 and 52, instead. The count of the drive pulses may start from the time when rotation of the pulse motors starts or the time when the limit switch 76 is depressed by the side walls of the thread cassette 20, instead. Thus, the count of the drive pulses may start from another phase.

The thread cassette 20 holds the needle thread 18 wound on the thread spool 24 in the foregoing embodiment. However, the needle thread 18 need not be wound on a core member such as the thread spool and may be drawable, instead. Furthermore, the thread cassette 20 has a wall surrounding the thread spool 24 in the foregoing embodiment. If only the thread spool can be disposed in the thread cassette 20, the wall may or may not be provided.

In the foregoing embodiment, reach of the reach of cassette 20 to the drive stop position where the drive of the pulse motors 50 and 52 is stopped is detected by the limit switch 80 having been depressed by the underside of the thread cassette. However, the reach may be determined on the basis of a predetermined period of time starting from a predetermined phase such as ON-OFF time of the limit switch 76 or the number of drive pulses supplied to the pulse motors 50 and 52 (an amount of rotation), instead.

Figure 10:
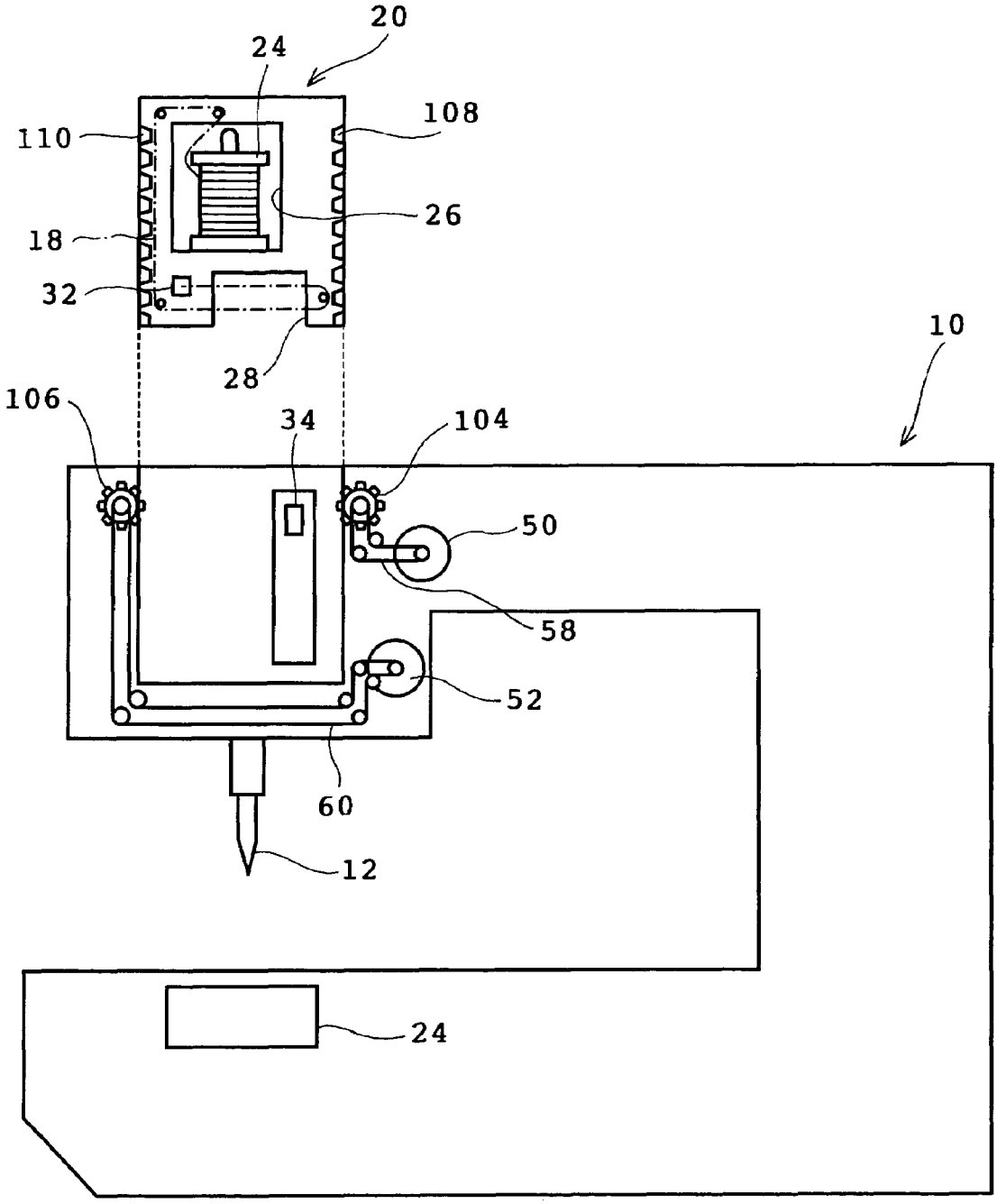
FIG. 10 is a front view of the sewing apparatus of a first modified form, showing a carrying mechanism using pinions.

The rubber rollers 64 and 66 are brought into contact with the thread cassette 20 in the foregoing embodiment. However, a pair of pinions 104 and 106 may be provided instead of the rubber rollers as shown in FIG. 10. In this case, the thread cassette 20 has racks which are formed on the opposed side walls thereof so as to be engaged with the pinions 104 and 106, so that the thread cassette is transferred while the pinions and racks are engaged with each other.

Figure 11:
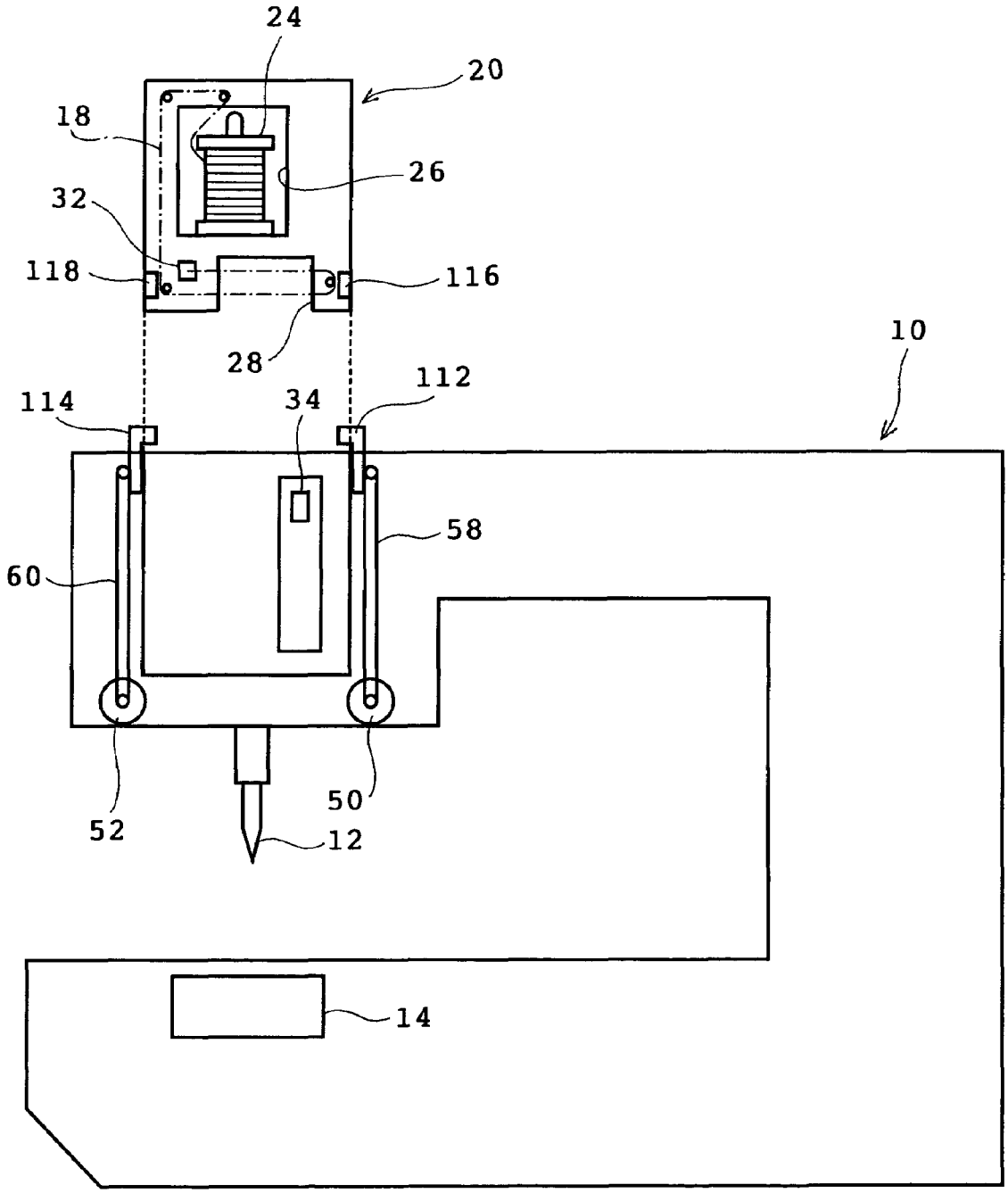
FIG. 11 is a front view of the sewing apparatus of a second modified form, showing a carrying mechanism moving an engagement claw.

Furthermore, the sewing machine 10 may be provided with a pair of vertically movable engagement claws 112 and 114, instead of the rubber rollers 64 and 66, as shown in FIG. 11. In this case, the thread cassette 20 is formed with depressions 116 and 118 engaging the engagement claws 112 and 114. The engagement claws 112 and 114 are engaged with the depressions 116 and 118 respectively so that the thread cassette 20 is transferred. More specifically, the thread cassette 20 may be transferred using a moved contact member instead of the rotating contact member. In this construction, a space between arms 120 and 122 with the engagement claws 112 and 114 respectively are spread slightly larger than the width of the thread cassette 20 in the right-and -left direction, only when the arms project above the sewing machine 10, whereby the claws are engaged with the respective depressions 116 and 118.

Figure 12:
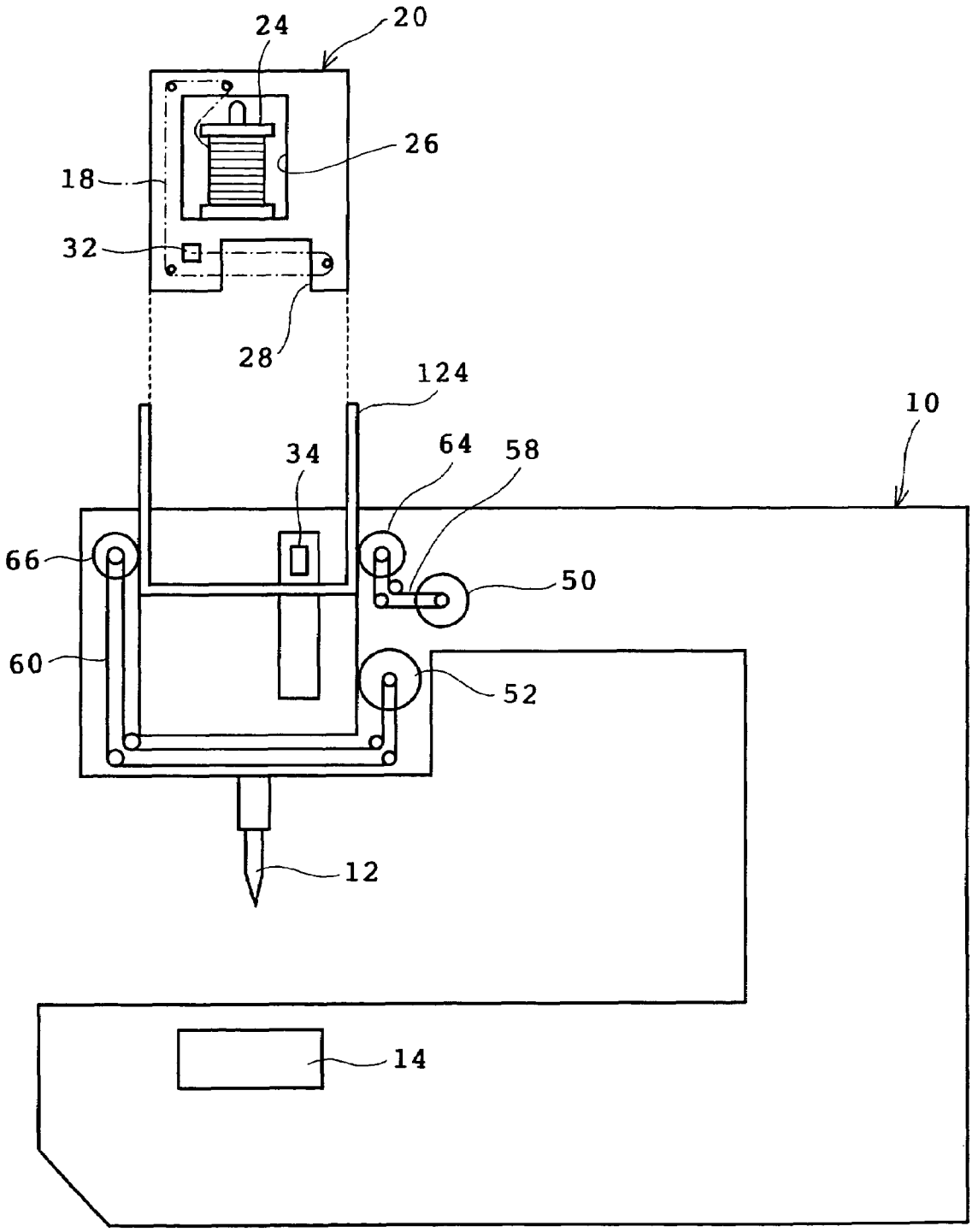
FIG. 12 is a front view of the sewing apparatus of a third modified form, showing a supporting member of the thread cassette.

The rubber rollers 64 and 66 are brought into contact with the thread cassette 20 in the foregoing embodiment. However, as shown in FIG. 12, a cassette supporting member 124 supporting the thread cassette 20 may be brought into contact with the rubber rollers 64 and 66, whereby the cassette supporting member is vertically moved together with the thread cassette by the rubber rollers so that the thread cassette is transferred, insteadly.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing apparatus in which a thread cassette holding a needle thread wound is used, comprising:

a cassette mount to which the thread cassette is detachably attached;

a carrier carrying the thread cassette and a motor that moves the carrier between an attachment start position and an attachment finish position in the cassette mount; and a control device for electrically controlling rotation of the motor.

2. A sewing apparatus according to claim 1, wherein the carrier includes a contact member brought into contact with the thread cassette or a supporting member when the thread cassette is supported by the supporting member and a driver for moving or rotating the contact member, and the control device controls the driver so that the contact member is moved or rotated in a predetermined direction for insertion of the thread cassette into the cassette mount.

3. A sewing apparatus according to claim 1, wherein the carrier includes a contact member brought into contact with the thread cassette or a supporting member when the thread cassette is supported by the supporting member and a driver for moving or rotating the contact member, and the control device controls the driver so that the contact member is moved or rotated a predetermined amount for insertion of the thread cassette into the cassette mount.

4. A sewing apparatus according to claim 2, further comprising a detector detecting the thread cassette or the supporting member placed at the attachment start position in the cassette mount, wherein the control device controls the driver so that the movement or rotation of the contact member in the predetermined direction is started when the detector has detected the thread cassette or the supporting member placed at the attachment start position.

5. A sewing apparatus according to claim 3, further comprising a detector detecting the thread cassette or the supporting member placed at the attachment start position in the cassette mount, wherein the control device controls the driver so that the movement or rotation of the contact member by the predetermined amount is started when the detector has detected the thread cassette or the supporting member placed at the attachment start position.

6. A sewing apparatus according to claim 2, further comprising a detector detecting the thread cassette or the supporting member having reached the attachment finish position, wherein the control device controls the driver so that movement or rotation of the contact member is stopped when the detector has detected the thread cassette or the supporting member having reached the attachment finish position.

7. A sewing apparatus according to claim 3, further comprising a detector detecting the thread cassette or the supporting member having reached the attachment finish position, wherein the control device controls the driver so that movement or rotation of the contact member is stopped when the detector has detected the thread cassette or the supporting member having reached the attachment finish position.

8. A sewing apparatus according to claim 6, wherein the control device controls the driver so that movement or rotation of the contact member is stopped when the detector has not detected the thread cassette or the supporting member having reached the attachment finish position, within a predetermined period of time or predetermined number of times of drive.

9. A sewing apparatus according to claim 7, wherein the control device controls the driver so that movement or rotation of the contact member is stopped when the detector has not detected the thread cassette or the supporting member having reached the attachment finish position, within a predetermined period of time or predetermined times of drive.

10. A sewing apparatus according to claim 6, further comprising a display device controlled by the control device, wherein when the detector has detected the thread cassette or the supporting member having reached the attachment finish position, the control device controls the display device so that an indication that the thread cassette has normally been attached to the cassette mount is displayed.

11. A sewing apparatus according to claim 8, further comprising a display device controlled by the control device, wherein when the detector has not detected the thread cassette or the supporting member having reached the attachment finish position within the predetermined period of time or predetermined times of drive, the control device controls the display device so that an indication that the thread cassette has not normally been attached to the cassette mount is displayed.

12. A sewing apparatus according to claim 11, further comprising a thread cassette detector for detecting the thread cassette having been ejected from the cassette mount, wherein the control device interrupts displaying by the display device when the thread cassette detector detects ejection of the thread cassette after the display device has displayed the thread cassette not having normally been attached.

13. A sewing apparatus according to claim 1, wherein the carrier includes a contact member brought into contact with the thread cassette or a supporting member when the thread cassette is supported by the supporting member and a driver for moving or rotating the contact member, and the control device controls the driver so that the contact member is moved or rotated in a predetermined direction for ejection of the thread cassette from the cassette mount.

14. A sewing apparatus according to claim 1, wherein the carrier includes a contact member brought into contact with the thread cassette or a supporting member when the thread cassette is supported by the supporting member and a driver for moving or rotating the contact member, and the control device controls the driver so that the contact member is moved or rotated a predetermined amount for ejection of the thread from the cassette mount.

15. A sewing apparatus according to claim 13, further comprising an ejection detector for detecting the thread cassette having been moved from the attachment finish position in the cassette mount, wherein when the ejection detector detects the thread cassette or the supporting member having been moved from the attachment finish position, the control device controls the driver so that the contact member is subsequently moved or rotated by predetermined amount.

16. A sewing apparatus according to claim 14, further comprising an ejection detector for detecting the thread cassette having been moved from the attachment finish position in the cassette mount, wherein when the ejection detector detects the thread cassette or the supporting member having been moved from the attachment finish position, the control device controls the driver so that the contact member is subsequently moved or rotated by predetermined amount.

17. A sewing apparatus according to claim 15, wherein the ejection detector comprises a limit switch detecting the thread cassette having been moved from the attachment finish position to a midway position between the attachment start position and the attachment finish position in the cassette mount.

18. A sewing apparatus according to claim 16, wherein the ejection detector comprises a limit switch detecting the thread cassette having been moved from the attachment finish position to a midway position between the attachment start position and the attachment finish position in the cassette mount.

19. A sewing apparatus according to claim 15, wherein when movement of the thread cassette or the supporting member from the attachment finish position is not detected within a predetermined time or within a predetermined number of times of drive, the control device controls the driver so that movement or rotation of the driver is interrupted.

20. A sewing apparatus according to claim 16, wherein when movement of the thread cassette or the supporting member from the attachment finish position is not detected within a predetermined time or within a predetermined number of times of drive, the control device controls the driver so that movement or rotation of the driver is interrupted.

21. A sewing apparatus according to claim 15, further comprising a display device controlled by the control device, wherein when the control device controls the driver and finishes a process for ejection of the thread cassette after the ejection detector has detected the thread cassette or the supporting member having been moved from the attachment finish position, the control device controls the display device so that normal ejection of the thread cassette is displayed.

22. A sewing apparatus according to claim 19, further comprising a display device controlled by the control device, wherein when movement of the thread cassette or the supporting member from the attachment finish position is not detected within a predetermined time or within a predetermined number of times of drive, the control device controls the display device so that an indication that the thread cassette has not been normally ejected is displayed.

23. A sewing apparatus according to claim 22, further comprising a thread cassette detector for detecting the thread cassette having been ejected from the cassette mount, wherein the control device interrupts displaying by the display device when the thread cassette detector detects ejection of the thread cassette after the display device has displayed the thread cassette not having normally been ejected.

24. A thread cassette for a sewing apparatus, the sewing apparatus including a threading mechanism provided at a sewing apparatus body side, a cassette mount to which the thread cassette is detachably attachable, a carrier carrying the thread cassette between an attachment start position and an attachment finish position in the cassette mount, and a control device for electrically controlling the carrier, the thread cassette being constructed so as to be attached to the cassette mount while a needle thread drawn therefrom extends right and left with respect to the thread cassette, the thread cassette being further constructed so that the needle thread is passed through an eye of a sewing needle by the threading mechanism with movement of the thread cassette during attachment, the thread cassette comprising:

a portion that actuates the control device, thereby causing the control device to electrically control the carrier, and a portion that is engaged by the carrier.

25. A computer program stored on a computer-readable medium, the program causing a computer to operate as a control device that controls a carrier carrying a thread cassette, which holds a needle thread wound for a sewing apparatus, between an attachment start position and an attachment finish position in a cassette mount to which the thread cassette is detachably attached so that the thread cassette is inserted into and ejected from the cassette mount in order that the thread cassette holding the needle thread may be used with the sewing apparatus.

* * * * *